US005471899A

United States Patent [19]

Twomlow

[11] Patent Number: 5,471,899

[45] Date of Patent: Dec. 5, 1995

[54] EXTENSIBLE RATCHET WRENCH

[76] Inventor: Daniel B. Twomlow, 24 Sedgewick Rd., Poughquag, N.Y. 12570

[21] Appl. No.: 260,462

[22] Filed: Jun. 14, 1994

Related U.S. Application Data

[63] Continuation-in-part of Ser. No. 90,542, Jan. 5, 1994, abandoned.

[51] Int. Cl.[6] ..... B25G 1/04

[52] U.S. Cl. ..... 81/60; 81/177.2; 403/109

[58] Field of Search ..... 81/60, 177.1, 177.2, 81/489; 16/115; 403/107–109, 325–327

[56] References Cited

U.S. PATENT DOCUMENTS

| | | | |
|---|---|---|---|
| 2,893,765 | 7/1959 | Lyon | 403/107 |
| 2,955,854 | 10/1960 | Musser | 403/109 X |
| 3,722,903 | 3/1973 | Jones | 403/107 X |
| 4,586,406 | 5/1986 | Howard | 81/177.2 |
| 4,957,387 | 9/1990 | Nasu | 403/327 X |
| 4,960,015 | 10/1990 | Mathews | 81/177.2 |
| 5,366,313 | 11/1994 | LaBarre | 403/108 |

*Primary Examiner*—D. S. Meislin
*Attorney, Agent, or Firm*—Joseph L. Spiegel

[57] ABSTRACT

An extensible ratchet wrench has a main inner shaft with a ratchet head at one end, aligned lock pin holes along the shaft, and a lengthwise grooved guiding track disposed on the opposite side of the shaft. An outer sleeve is mounted telescopically and fits snugly about the main shaft for axial movement relative thereto. The proximal end of the sleeve is of reduced outside thickness with oppositely disposed holes for receiving both bearings, the holes being aligned with the shaft lock pin holes and guiding track. A locking collar disposed about the proximal end fits about the proximal end of the sleeve and has a spirally grooved interior at its distal end for receipt of a spring and internal ball bearing channels at its proximal end.

1 Claim, 2 Drawing Sheets

EXTENSIBLE RATCHET WRENCH

This application is a continuation-in-part of my application Ser. No. 08/090,542, filed Jan. 5, 1994, now abandoned.

BACKGROUND OF THE INVENTION

1. Field of the Invention

This invention relates generally to tools with extensible handles and, in particular, to an extensible ratchet wrench.

2. Description of the Prior Art

Clothier et al., U.S. Pat. No. 2,963,930 describes an extensible torque bar having an inner shaft with spaced depressions along the shaft, an outer tube, a single ball bearing for communicating through the torque tube to the depressions of the torque bar and a slidable locking sleeve with ball ridge and ball chamber therein, the sleeve being spring biased to constrain the ball within one of the depressions.

In Jeannotre, U.S. Pat. No. 4,070,932 an outer sleeve which supports a tool headpiece at one end thereof is mounted telescopically about an internal rod. The rod has a groove with a longitudinal portion and transverse leg portion. A latch mechanism with an inwardly extending abutment carried by a sleeve secures the rod in its position of extension or retraction by disposing the abutment in one of the transverse leg portions. A coil spring biases the rod towards an outward position.

Newby et al., U.S. Pat. No. 4,376,397 describes an adjustable extension device for tools in which a latch member passes through an outer female member or sleeve into one of a plurality of longitudinally spaced detents in an inner male member or rod.

Shull, U.S. Pat. No. 4,581,958 describes an extensible handle assembly for a ratchet wrench having a tubular handle member with a central hole down its length and a tool engaging shank extending through the central hole. The shank is slidable in the handle member between extended and retracted positions and includes a transverse spring-loaded detent to engage the shank at each of those positions.

Thomas, U.S. Pat. No. 5,033,337 discloses an extension element for use with wrench type hand tools. The element includes a rectangular bored handle that receives an extension arm which has a plurality of spring loaded ball bearings within transverse spread apart transverse bores. The handle is also provided with a transverse bore. A spring in one of the arm handle bores forces its ball into the handle bore to lock the extension arm in place. The transverse bores give rise to inherent weakness in handle and arm.

In Raber, U.S. Pat. No. 5,109,737, a spring loaded detent in the handle of a ratchet tool is adapted to extend into one of a plurality of aligned holes in a sleeve member. Raber is inherently a weak device structurally. Any undue stress would cause this tool to snap.

Lan, U.S. Pat. No. 5,138,911 is another telescopic wrench extension, but structurally weak due to a longitudinal slot in a telescopic tubular sleeve member.

In Lee, U.S. Pat. No. 5,193,149 the sleeve portion of an extensible wrench includes a transverse hole in its flange portion that goes all the way through creating a weakness in same.

Hillinger, U.S. Pat. No. 5,285,702 describes an extendible tool handle wherein an outer handle member defines an air chamber about an inner handle member.

The prior art devices suffer from inherent structural weakness, limited extendibility and limited choice of lengths.

SUMMARY OF THE INVENTION

Accordingly, the primary object of this invention is the provision of an extensible ratchet wrench that is simple to manufacture but is of strong design, particularly in the extended position.

BRIEF DESCRIPTION OF THE DRAWING

Other objects, features and advantages of the invention will be apparent from the following description taken in connection with the accompanying drawing, wherein.

DETAILED DESCRIPTION OF THE PREFERRED EMBODIMENT

Figure 1:
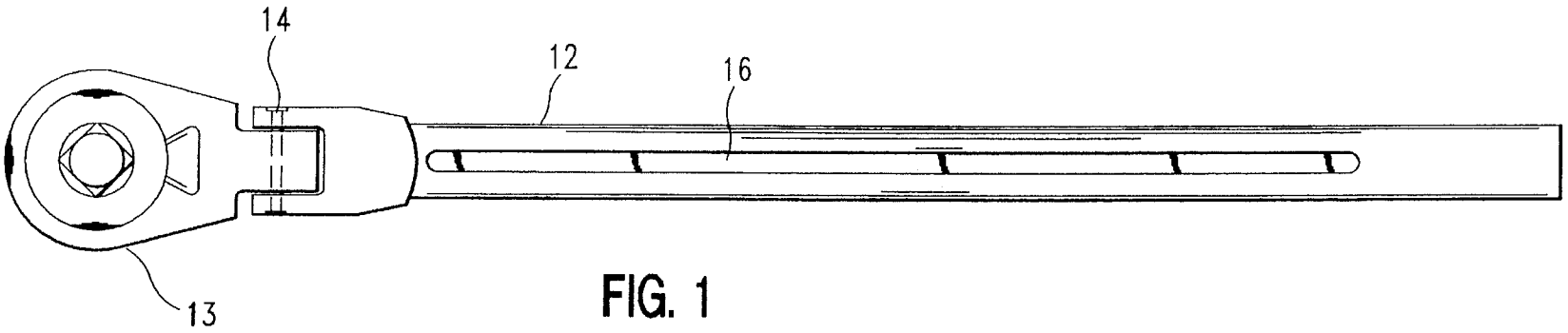
FIG. 1 is a bottom view of the main shaft with tool headpiece of the tool of the present invention.
Figure 2:
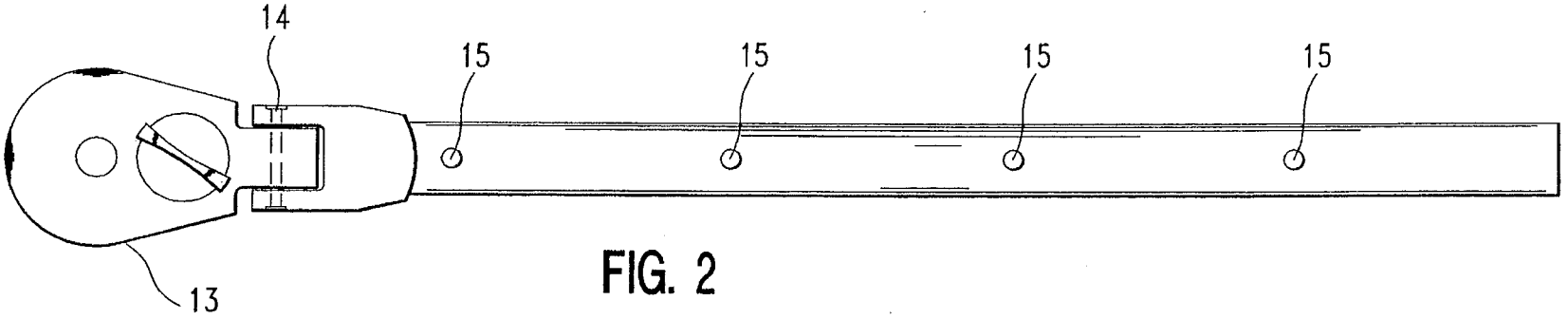
FIG. 2 is a top view of the main shaft with tool headpiece of the tool of the present invention.

Referring first to FIG. 1 and 2 of the drawing, the tool is seen as including a main shaft 12 with a tool headpiece 13 such as a ratchet wrench at its proximal end. The tool headpiece 13 is shown being pivotable about an axle at 14. The shaft 12 as well as all the major parts preferably are constructed of tool steel.

Main shaft 12 is provided along its top surface with a series of aligned, spaced lock pin holes 15 or depressions, the depth and shape of same being such as will accommodate a locking pin or ball bearing to be described hereafter. On the opposite side or bottom surface main shaft 12 is provided with a lengthwise control groove 16 extending from the tool headpiece 13 or proximal end to near its distal end.

Figure 3:
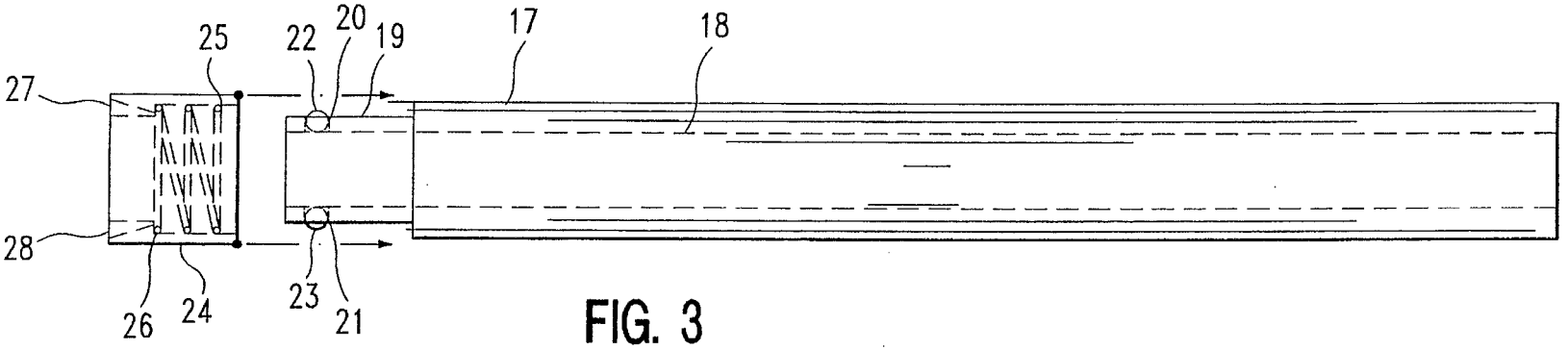
FIG. 3 is a side view partly in section of the outer shaft of the tool of the present invention.

Referring to FIG. 3 the tool of the present invention is seen as including an outer shaft or sleeve 17 with an axial channel 18 of circular cross section extending therethrough. The shaft or sleeve 17 is milled down at its proximal end at 19 to accept a locking collar to be described hereafter, and is provided with openings on opposite sides at 20, 21 for receipt of ball bearings or lock pins 22, 23. The openings 20, 21 are of slightly less diameter than that of the ball bearings 22, 23 so that the ball bearings will rest in holes 20, 21 on the outer side of the milled end 19 of sleeve 17. Sleeve 17 is sized to move smoothly but fit snugly about main shaft 12. Just enough clearance is provided so that the main shaft 12 can slide within sleeve 17, to keep the shaft 12 and sleeve 17 from rotating relative to one another and to prevent inner shaft bending.

The tool is further shown in FIG. 3 as including a locking collar 24 and retaining spring 25 for holding the collar in place and locking the ball bearings or pins 22, 23 in place. The interior of the distal end of collar 24 is spirally grooved at 26 for receipt of spring 25 and is provided at the proximal end with retaining channels 27, 28 for retaining the ball bearings 20, 21 in the holes 22, 23.

The ball bearings 22, 23 are placed in openings 20, 21, the spring 24 is placed in collar 25, the collar placed over the proximal end 19 of the sleeve 17 and the main shaft 12 slid into the sleeve 17.

Figure 4:
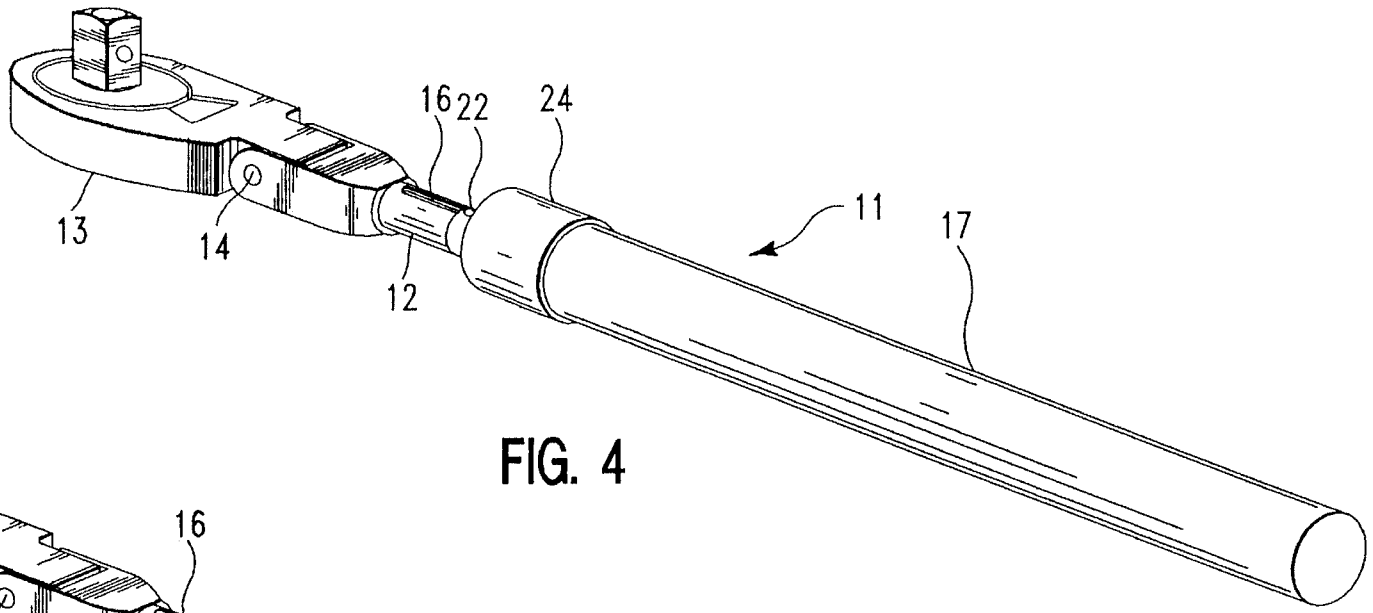
FIG. 4 is a perspective of the tool of the present invention fully assembled and in retracted position; and, FIG. 5 is a perspective view of the tool of the present invention similar to FIG. 4 but in extended position.
Figure 5:
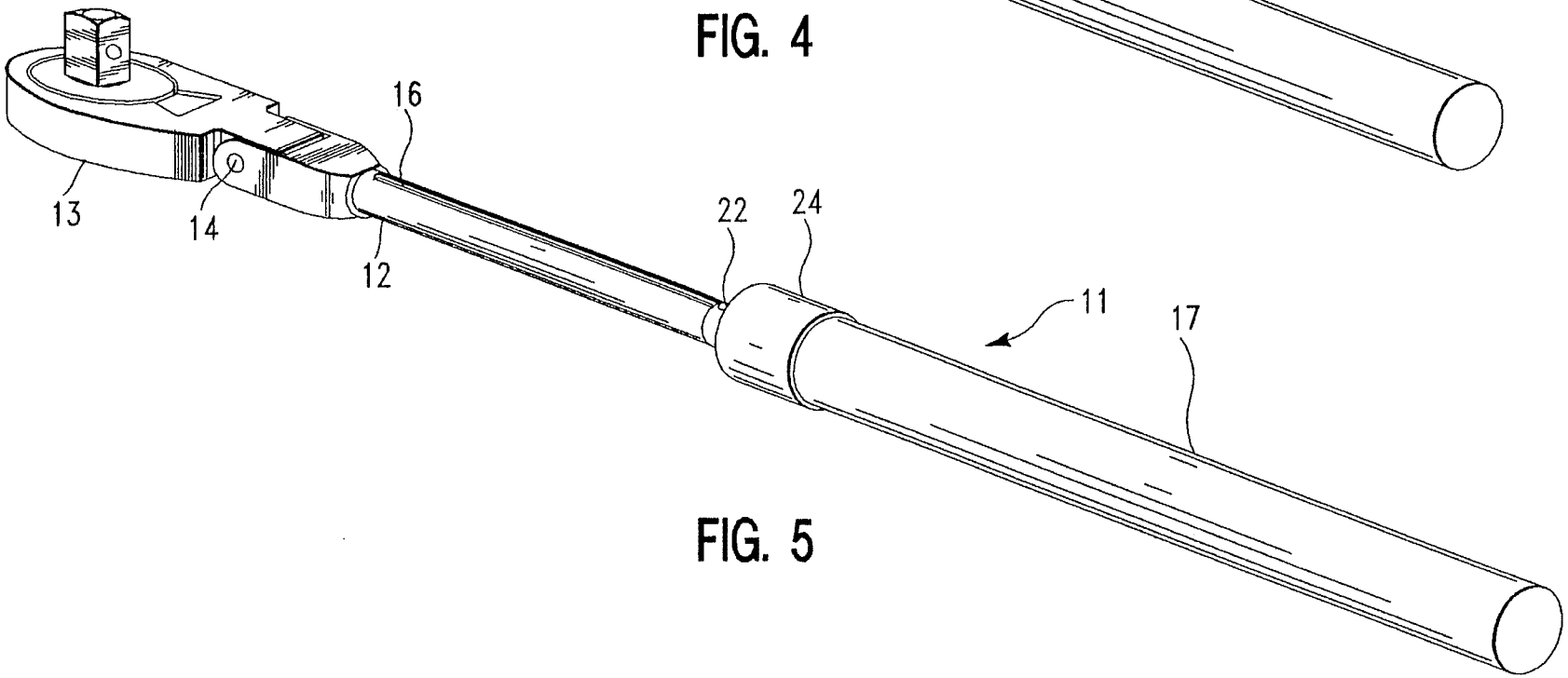

FIG. 4 shows tool 11 completely assembled but in a retracted position while FIG. 5 shows the tool in extended position. Locking pin or ball bearing 21 will be locked in place in one of the locking pin holes 15 along main shaft 12 as the opposite locking pin or ball bearing 22 rides smoothly within groove 16. Groove 16 acts as a control groove to keep the tool 11 from twisting and turning during use.

Movement between retracted position and one of the extended positions is accomplished by depressing collar 24 away from the tool headpiece 13 and sliding outer sleeve 17 away from the tool headpiece until upper ball bearing 22 drops into one of the desired depressions 15. The collar is returned to its normal position and the ball bearing 22 is held in place in a depression 15.

Due to simple design, repair and maintenance can be done extending the lift of the tool.

While the invention has been particularly shown and described with reference to the preferred embodiment thereof, it would be understood by those skilled in the art that changes in form and detail and omissions may be made without departing from the spirit and scope of the invention.

What is claimed is:

1. An extensible ratchet wrench comprising:

a main shaft having a ratchet head at a proximal end of said shaft, aligned lock pin holes space along said shaft, and a lengthwise grooved guiding track disposed in said shaft opposite said aligned lock pin holes and extending from said shaft proximal end to near a distal end of said shaft;

an outer sleeve mounted telescopically and fitting snugly about said main shaft for axial movement relative to said main shaft having a proximal end of reduced outside thickness with a pair of oppositely disposed holes for receiving ball bearings adapted to be aligned with said aligned lock pin holes and track;

a pair of ball bearings disposed within said proximal end holes; and, a locking collar disposed about the proximal end of said sleeve, said collar including a spirally grooved interior at its distal end for receipt of a spring, a spring disposed within said grooved interior, and internal ball bearing channels at its proximal end.

* * * * *